US005329860A

United States Patent [19]

Mattesky

[11] Patent Number: 5,329,860

[45] Date of Patent: Jul. 19, 1994

[54] DOOR MOUNTED IRONING BOARD

[75] Inventor: Henry Mattesky, Cedar Grove, N.J.

[73] Assignee: Herbert Glatt, Morristown, N.J.

[21] Appl. No.: 675,322

[22] Filed: Mar. 26, 1991

[51] Int. Cl.[5] ..... A47B 5/00

[52] U.S. Cl. ..... 108/48; 108/42

[58] Field of Search ..... 108/42, 47, 48, 46, 108/38, 34, 40, 152

[56] References Cited

U.S. PATENT DOCUMENTS

| | | | |
|---|---|---|---|
| 2,014,549 | 9/1935 | Behm | 108/48 X |
| 2,460,712 | 2/1949 | Peterson | 108/48 X |
| 2,814,892 | 12/1957 | Larsen | 108/48 |
| 4,779,539 | 10/1988 | Stiglich | 108/48 |
| 4,834,332 | 5/1989 | Vanderbilt | 108/48 X |
| 4,862,611 | 9/1989 | Wright | 108/38 X |
| 4,870,907 | 10/1989 | McKee | 108/42 |
| 4,961,388 | 10/1990 | Simpson | 108/42 |
| 4,976,205 | 12/1990 | Miller et al. | 108/47 |

FOREIGN PATENT DOCUMENTS

| | | | |
|---|---|---|---|
| 1266596 | 6/1961 | France | 108/48 |
| 2466217 | 4/1981 | France | 108/42 |

*Primary Examiner*—Jose V. Chen

*Attorney, Agent, or Firm*—Omri M. Behr; Matthew J. McDonald

[57] ABSTRACT

An ironing board assembly is arranged for mounting on a door. The assembly has a frame with a transverse member and an upright member attached centrally to the transverse member. An upper gripper is attached atop the frame and is sized to hang from the top of the door. The assembly has an ironing board hingedly attached to the transverse member. Also, included is a stabilizing device mounted on the frame below the upper gripper for laterally stabilizing the ironing board assembly.

20 Claims, 3 Drawing Sheets 32
30
44
46
48
D
34
10
14
12
H
15
36
40
42
38
10
22
28
24
26
72
82
82
38
36
40
34

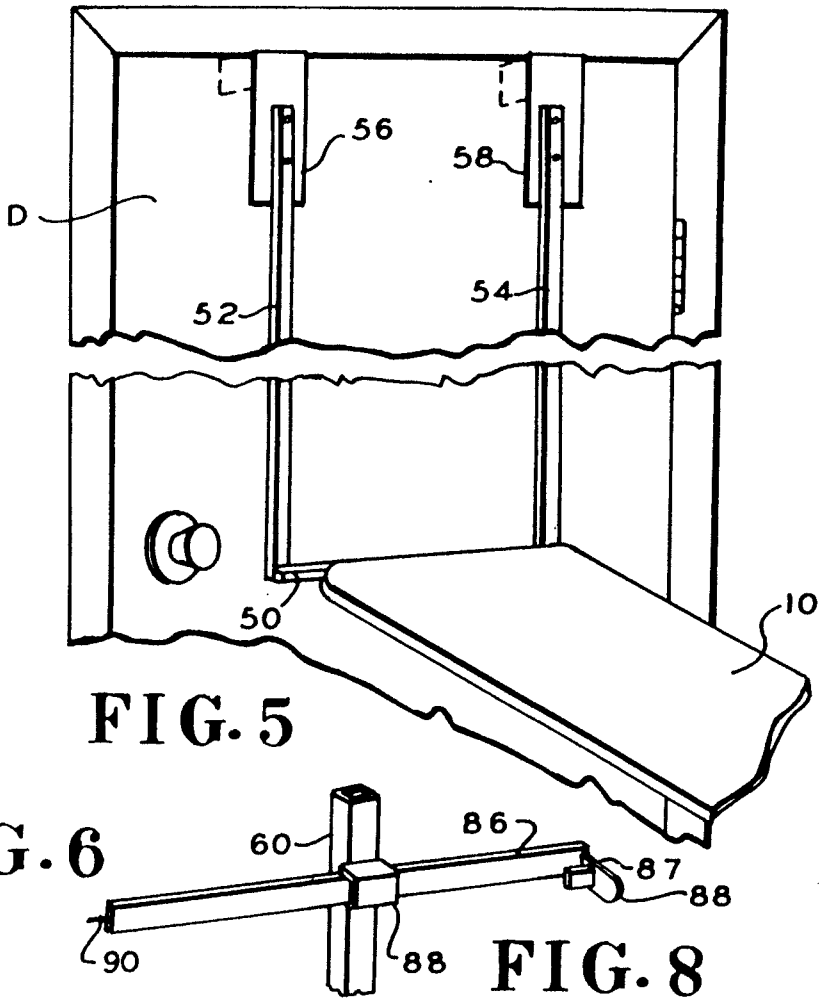
FIG. 5
FIG. 8
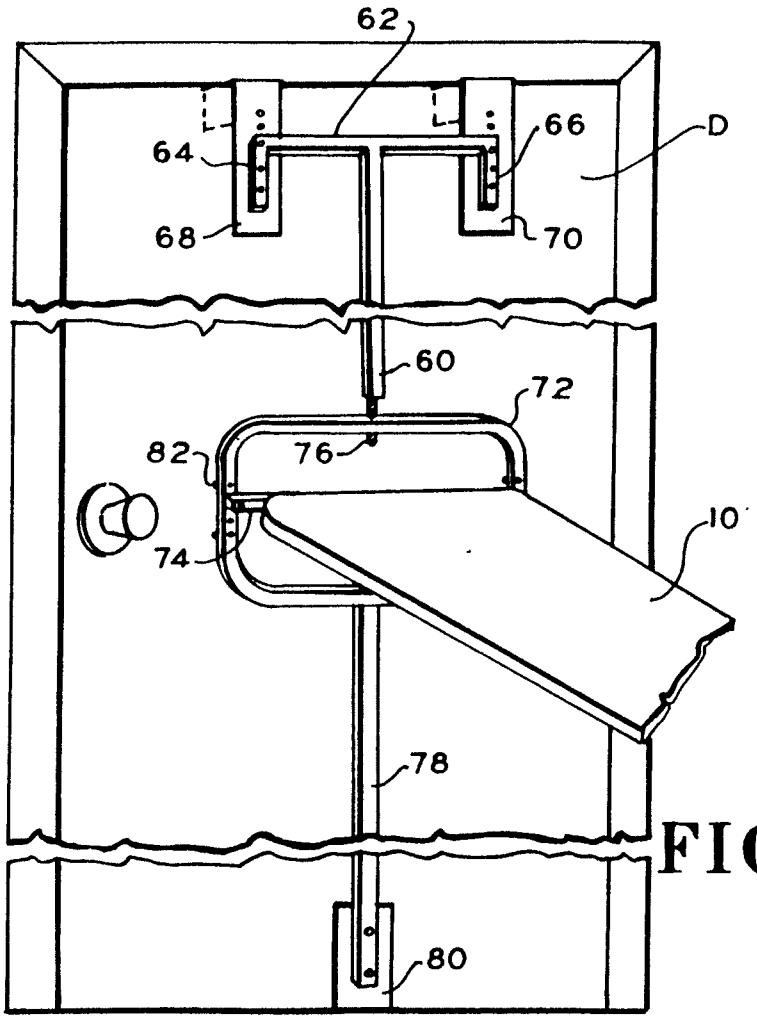
FIG. 6

DOOR MOUNTED IRONING BOARD

BACKGROUND OF THE INVENTION

The present invention relates to ironing board assemblies, and in particular, to assemblies designed for stable mounting on a door.

Using collapsible ironing boards can be inconvenient because they must be retrieved from storage before unfolding. When the ironing board must be used repeatedly, the transporting and unfolding can be tedious. A more convenient folding ironing board is hingedly attached in a recess in a wall or in a cabinet built upon a wall. Such an ironing board can be lifted into the recess or cabinet and quickly stored. The stored board can be concealed by a door. While this known assembly is convenient to use, it is expensive to install and requires skilled carpentry.

An important consideration when designing a folding ironing board assembly, is stabilizing it from shifting during use. Another important consideration is the ease of installation, but a simple and easily installed board assembly may not be able to avoid lateral shifting. Thus, if an ironing board assembly is attached to a wall or a door, the board must either be rigidly attached or attached in such a way that the likelihood of lateral slippage is minimized. A disadvantage with known ironing board assemblies is the difficulty in enhancing both the ease of installation and the lateral stability.

A known ironing board assembly has an inverted U-shaped frame with upper hooks that hold the frame to the top edge of a door. The ironing board can be hingedly mounted on the lower prongs of the inverted U-shaped frame. (For example, U.S. Pat. No. 4,976,205). Such an assembly unfortunately has a relatively heavy frame that can be dislodged when the door supporting the frame is swung. Furthermore, these known ironing board assemblies employ suction cups that have proved unreliable for holding the assembly in a laterally stable position.

Accordingly, there is a need for an improved ironing board assembly that is relatively compact, is easily installed and has good lateral stability.

SUMMARY OF THE INVENTION

In accordance with the illustrative embodiments, demonstrating features and advantages of the present invention, there is provided an ironing board assembly arranged for mounting on a door. The assembly has a frame with a transverse member and an upright member. The upright member is attached centrally to the transverse member. The assembly has an upper gripper attached atop the frame and sized to hang from the top of the door. Also included is an ironing board hingedly attached to the transverse member. The assembly also includes a stabilizing means mounted on the frame below the upper gripper for laterally stabilizing the ironing board assembly.

In a related embodiment of the same invention, the ironing board assembly includes a spaced pair of upright members attached atop either end of a transverse member. A pair of upper grippers is attached atop corresponding ones of the upper members. Each of the grippers is sized to hang from the top of the door. Again, an ironing board is hingedly attached to the transverse member. A stabilizing means is also mounted on the frame below the upper grippers for laterally stabilizing the ironing board assembly.

In a further embodiment of the same invention, an ironing board assembly has a frame with a transverse member. This transverse member has a rear adhesive for securing the member to the door. An upper gripper is attached atop the frame and is sized to hang from the top of the door. Again, an ironing board is hingedly attached to the transverse member.

In still another embodiment of the same invention, an ironing board assembly has a frame with a transverse member. An upper gripper is attached atop the frame and is sized to hang from atop the door. A lower gripper is attached to the frame and sized to grasp the bottom of the door. Again, an ironing board is hingedly attached to the transverse member.

By employing apparatus of the foregoing type, an improved ironing board assembly is achieved. In one preferred embodiment, an inverted T-shaped frame has an upper hook and a lower transverse member. The transverse member is, in one embodiment, adhesively secured to the door. Hingedly attached to the outside of the transverse member is a foldable ironing board. Under the bow of the ironing board, an adjustable leg can articulate to form an obtuse angle between the leg and the length of the board. This obtuse angle ensures that weight on the board tends to push the board against the door to make the adhesive joint between the transverse member and door more secure. This stabilizing effect is amplified by providing the angle between the board and the door is made slightly less than 90°, say 86°–88°. This does not impair the function of the board. An advantage with the inverted T-shape of the frame is that the size and weight of the frame is kept relatively small. Thus there is no unnecessary weight that would tend to dislodge the frame when the door is used normally.

The preferred embodiment can have numerous features such as a height adjustment by adjusting the hook position and adjusting the length of the leg. The leg can also be equipped with a locking mechanism, which locks the leg at an obtuse angle for greater stability. Another feature in one preferred board assembly, is a transverse latch attached to the frame to hold the ironing board in a folded position. In an alternate embodiment, the upper hook can become a pair of spaced hooks mounted from a horizontal bar at the top of the frame.

In still another embodiment, the inverted T-shaped frame can be replaced with a pair of upright members having upper hooks for hanging a transverse member from a door. As before, the ironing board can be hingedly attached to the transverse member, whose rear face can be adhesively secured to a door.

Still another embodiment can employ an elongate frame with upper and lower hooks that grip the top and bottom of a door, respectively. In this embodiment, the upper and lower hooks can be brought together by a turnbuckle effect. For example, a threaded rod can connect the transverse member to either the upper or the lower hook. By turning the threaded rod, tension between the upper and lower hooks can be increased. This tension can be increased by the use of one or more spacers mounted on the back of the frame, so that the frame, under tension, is slightly bowed away from the door. This embodiment can also include a transverse member in the form of a hoop, bisected by a horizontal beam. The ironing board can be hingedly attached to the horizontal beam.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein:

FIG. 5 is a front view of an assembly that is an alternate to that of FIG. 1;

FIG. 6 is a front view of another assembly that is an alternate to that of FIG. 1;

FIG. 8 is a detailed view of a latch that is an alternate to that of FIG. 1.

DETAILED DESCRIPTION OF THE PREFERRED EMBODIMENTS

Figure 1:
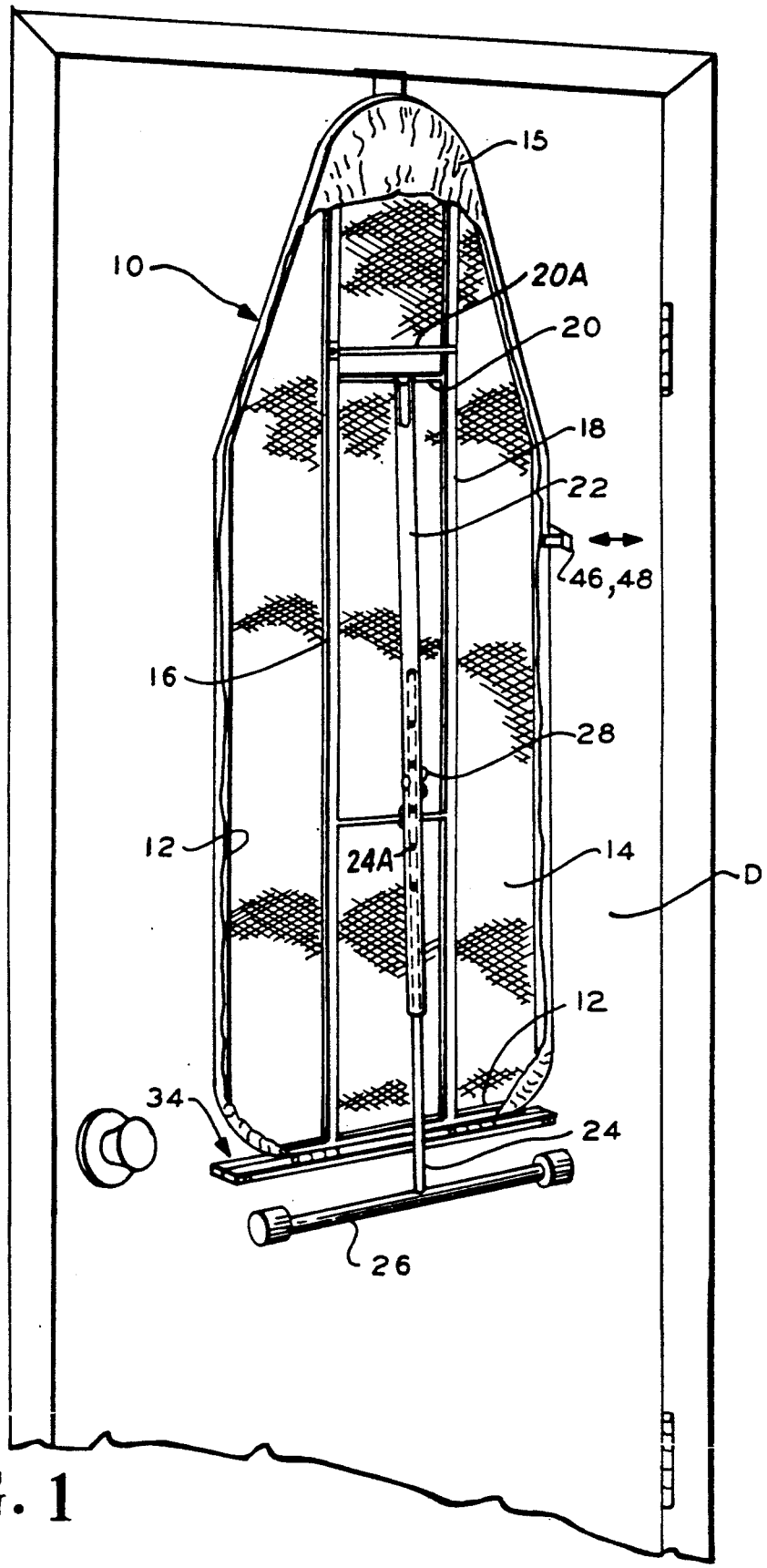
FIG. 1 is a front view of an ironing board assembly attached to a door and folded into a stored position, in accordance with the principles of the present invention.

Referring to FIGS. 1–4, an ironing board assembly employs a conventional ironing board 10. Board 10 has a peripheral frame 12 supporting a metal grating 14 acting as a bed for supporting the work surface. A pair of parallel beams 16 and 18 run fore and aft below the board to provide additional support. Board 10 has a cover 15 of a conventional type.

A rod 20 is journaled between beams 16 and 18 to allow articulation of hollow leg 22. Leg 22 is fitted with a foot having a telescopically mounted rod 24. Rod 24 has a plurality of diametric holes (not shown) and a lower brace 26 providing a stable base. Rod 24 is held in position in leg 22 by means of a cross piece shown as wing bolt 28, which is fastened through a side aperture of leg 22 into one of the holes 24A in rod 24. The cross piece 28 can be unthreaded from the position shown so that rod 24 can be adjusted within leg 22 to change the overall length. Once repositioned, the cross piece 28 can be rethreaded into a new hole.

A frame is shown as an upright member 30 in the form of a rectangular tube. The upper end of tube 30 is bolted to an upper gripper, shown herein as upper hook 32. Hook 32 has an inside flat face bolted to tube 30, a horizontal piece resting atop door D and a rear tab to prevent hook 32 from sliding off the top of door D. Hook 32 can be bolted at adjustable heights on tube 30 to change the working height of ironing board 10.

Figures 2, 3, 4, 7:
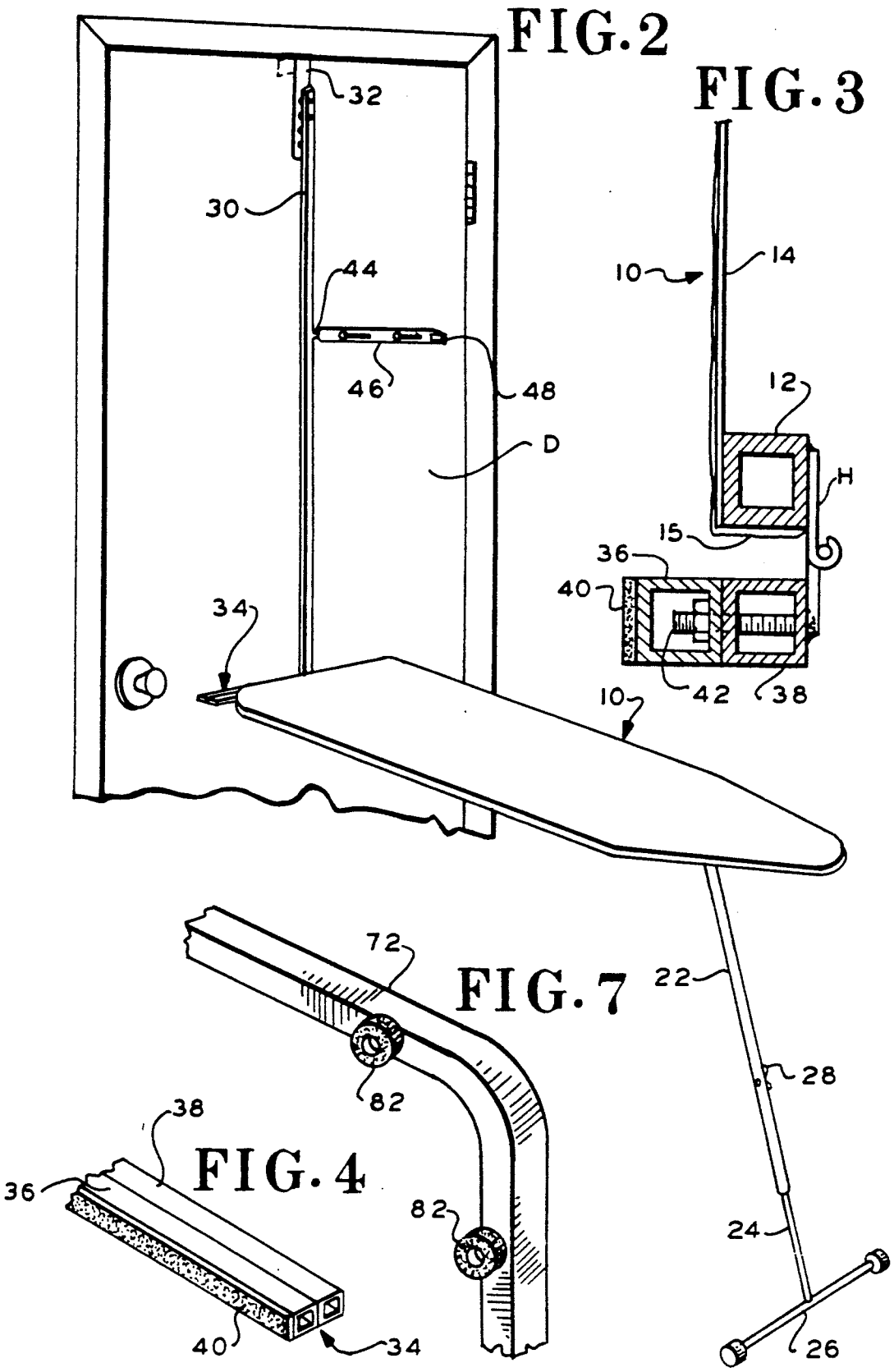
FIG. 2 is a front view of the assembly of FIG. 1 with the board deployed to a working position.
FIG. 3 is a detailed, cross sectional view of the hinged joint of the assembly of FIG. 1.
FIG. 4 is a rear perspective view of a fragment of the transverse member of FIG. 1.
FIG. 7 is detailed rear perspective view of a corner of the hoop of FIG. 6.

A transverse member is shown herein as a pair of rectangular tubes 36 and 38 (FIGS. 3 and 4). The lower end of upright member 30 is welded to the center of tube 36. Tube 38 is attached to rear tube 36 by means of bolt and nut 42.

A stabilizing means is shown herein as an adhesive backing 40 on the rear face of tube 36. Adhesive 40 can be any one of several adhesive layers. Preferably, adhesive 40 is a plastic foam having adhesive backing on opposite faces. Thus the foam can adhere to the rear face of tube 36 and to the face of door D. The foam allows a certain amount of give so that the adhesive bond is not broken by ordinary shocks.

In FIG. 3, frame 12 of ironing board 10 is welded to the outer wing of hinge H. The inner wing of hinge H is welded to the outside face of tube 38. Accordingly, ironing board 10 can rotate around the axis of the hinge H to move from the folded position shown in FIGS. 1 and 3 to the extended position shown in FIG. 2.

Leg 22 can have stops or other devices to limit the angle of rotation so that the leg is normally extended to the position illustrated in FIG. 2; that is, at an obtuse angle to the length of board 10.

Perpendicularly welded from the side of the midsection of upright 30 is slider support bar 44. Bar 44 has a pair of studs that are slidably locked into a pair of slots in latch 46. Latch 46 is a flat slider having a hook-like catch 48 at its outer end with a finger grip for laterally sliding the catch by hand, as indicated by the double headed arrow. As shown in FIGS. 1 and 2, the ironing board 10 can be folded upwardly and the latch 46 can be secured around the edge of the ironing board to hold it in a folded position. Referring to FIG. 5, previously illustrated ironing board 10 is hingedly attached to a transverse member 50. Transverse member 50 is structured the same as before (that is, as member 34 of FIGS. 1–4). In this embodiment, however, a pair of upright members 52 and 54 are separately welded to each end of transverse member 50. Each of the upright members 52 and 54 are bolted at adjustable positions on grippers, shown herein as upper hooks 56 and 58. Transverse member 50 has an adhesive backing as before to keep it laterally stable.

Referring to FIG. 6, a frame is shown with an upright member 60 in the form of a rectangular tube. Welded atop tube 60 is a cross member 62 whose opposite ends support vertical tube segments 64 and 66. Bolted at adjustable positions on segments 64 and 66 are a pair of upper grippers 68 and 70 in the form of hooks similar to that previously illustrated.

A hoop 72 is shown with a generally rectangular perimeter and rounded corners. The vertical sides are drilled to provide mounting holes that support at adjustable positions horizontal beam 74. Ironing board 10 is hingedly connected to beam 74 in a manner similar to that previously described.

A threaded rod or threaded bolt 76 connects between upright member 60 and hoop 72. Rod 76 can be screwed to bring upright member 60 closer to hoop 72. For example, rod 76 can be threaded into hoop 70 but mounted in upright member 60 to rotate without threading. Alternatively, rod 76 can be threaded into upright member 60, but mounted to rotate without threading in hoop 72. In some embodiments, rod 76 will extend to the top of upright member 60. The rod 76 can then be screwed by using a wrench or screwdriver at the lower or the upper end of rod 76.

Attached centrally to the bottom of hoop 72 is rectangular tube 78, whose lower end has a gripper, shown herein as a hook-shaped device 80. Device 80 can be built similarly to upper hooks 68 and 70. A second threaded rod 176 (not shown) can connect the lower horizontal member of hoop 72 with upright 78. Similarly, second threaded rod 176 may be used in place of threaded rod 76.

FIG. 7 shows elastometric bumpers 82 on the rear of hoop 72. Bumpers 82 are shown screwed to hoop 72 on opposite sides of each corner of the hoop. Alternatively, bumpers 82 can be replaced with an adhesive layer, similar to that previously described.

The ironing board assembly of FIG. 6 can be attached to door D by hanging the assembly, without rod 78, on the door from hooks 68 and 70 and 80 in the positions shown. Thereafter, 80 hook is slid under the door and rod 78 attached to hoop 72 via threaded rod or bolt 176 can be bolted to the assembly as illustrated in FIG. 6. Next, rod 76 can be rotated to increase the tension between upright members 60 and 78. This causes hooks 68, 70 and 80 to positively grip door D and greatly enhance lateral stability. When mounted in this position, bumpers 82 (or alternatively an adhesive backing) also helps keep hoop 72 laterally stable.

Several variations of this system will be apparent to one skilled in the art. Convenience dictates that one vertical rod, suitably 78 is removable and at least one vertical rod is tensionable. Thus either rod 78 or 60 could, if desired, be welded to hoop 72 while the remaining rod is both removable and tensionable.

In FIG. 8, an alternate latch 86 is slidably supported within a sleeve 88. Sleeve 88 is a C-shaped member welded to previously illustrated upright member 60 (FIG. 6). Latch 86 has a hook-shaped catch 87 with a finger grip 88. A rod 90 is attached behind catch 86 and slides in a block (not shown) to keep the latch 86 in position.

To facilitate an understanding of the principles associated with the foregoing apparatus, the operation of the ironing board assembly will be described in connection with FIGS. 1–4. It will be appreciated that the operation of the other embodiments is substantially the same.

The assembly of FIG. 2 is initially installed by placing the hook 32 over the top of the door D. The vertical position of upright member 30 can be adjusted by bolting hook 32 at a selected position. The adhesive backing 40 of tube 36 is now exposed. Keeping member 30 plumb the adhesive backing 40 is pressed against the door D to hold the upright member 30 in a vertical position.

Ironing board 10 can be stored by folding it upwardly from the position shown in FIG. 2 to that of FIG. 1. Thereafter the catch 46 can be thrust inwardly to hold the board as shown.

When ironing board 10 is to be used, catch 46 is pulled outwardly. Thereafter, board 10 is folded down and leg 22 is extended to the obtuse angle illustrated in FIG. 2. At this time, the extension of foot 24 can be adjusted by using wing nut 28, so that the board 10 is horizontal. With leg 22 at an obtuse angle, the weight on board 10 thrusts the board back against the door D. Thus, the adhesive backing on transverse member 34 is more securely affixed to the door D. Consequently, board 10 is laterally stable when in use. Furthermore, the frame comprising the upright member 30 and transverse member 34 is relatively compact and light. Thus the swinging of door D does not easily dislodge the frame.

It is to be appreciated that various modifications may be implemented with respect to the above described preferred embodiments. For example, the various structural members can be formed of round tube, solid rod, flat bars or other structures, depending upon the desired weight, strength, durability etc. Also, in some embodiments, the hooks may be replaced with other fastening devices such as plates for screwing the device to the door. Additionally, the latch can be removed and the hinged joint for the ironing board can have a detect to lock the board in an upright position. Alternatively, the latch can be placed at the top of the upright member to hold the outer tip of the board. Also, the leg can be extended at various angles, although it is preferably at an obtuse angle. In addition, the height adjustment of the leg can be performed by various means including a jackscrew or other means.

Obviously, many modifications and variations of the present invention are possible in light of the above teachings. It is therefore to be understood that within the scope of the appended claims, the invention may be practiced otherwise than as specifically described.

What is claimed is:

1. An ironing board assembly arranged for mounting on a door, comprising:

a mounting means having a transverse member and an upright member attached centrally to said transverse member;

an upper gripper attached atop said mounting means and sized to hang from the top of said door;

an ironing board hingedly attached to said transverse member;

stabilizing means mounted on said mounting means below said upper gripper for laterally stabilizing said ironing board assembly, said stabilizing means including a resilient layer having on opposite sides thereof an adhesive backing, said layer being rearwardly affixed to said transverse member for securing said member to said door, said layer being able to absorb shocks by giving without dislodging, said layer comprising a compressible foam; and a leg hingedly attached below said board distal to said transverse member.

2. An ironing board assembly according to claim 1 wherein said leg is attached to articulate from a folded position against said board through an obtuse angle to an extended position, so that said board when unfolded tends to be thrust against said transverse member.

3. An ironing board assembly according to claim 2 wherein the angle formed between the door and the extended board is less than 90°.

4. An ironing board assembly according to claim 3 wherein said leg has an adjustable length.

5. An ironing board assembly according to claim 4 wherein said leg comprises a foot telescopically mounted in said leg.

6. An ironing board assembly according to claim 5 wherein said leg has a lower hollow communicating with a side aperture, and wherein said foot comprises:

a rod slidably mounted in said hollow of said leg and having a spaced plurality of adjustment holes; and a crosspiece mounted through said side aperture of said leg into one of said adjustment holes in said foot.

7. An ironing board assembly according to claim 4 wherein said leg comprises:

means for limiting the angle of rotation of said leg to an obtuse angle to the board whereby that said leg cannot pivot when in an extended position.

8. An ironing board assembly according to claim 2 further comprising:

a latch mounted on said upright member to transversely reciprocate thereon, said latch having an outer catch sized to engage and hold said board when in its folded position.

9. An ironing board assembly according to claim 8 wherein said upper gripper comprises a hook adjustably attached to said frame to mount it at an adjustable height.

10. An ironing board assembly according to claim 2, wherein said stabilizing means comprises an adhesive rearwardly affixed to said transverse member for securing said member to said door.

11. An ironing board assembly according to claim 1 wherein said upper gripper comprises:

a transversely spaced pair of hooks.

12. An ironing board assembly according to claim 1 further comprising: a lower gripper attached to said frame and at least one threaded rod sized to grasp the bottom of said door.

13. An ironing board assembly according to claim 12 wherein said lower gripper comprises a hook shaped device.

14. An ironing board assembly according to claim 12 wherein said stabilizing means is operable to adjust the spacing between said upper and said lower grippers.

15. An ironing board assembly according to claim 14 wherein said stabilizing means comprises:

at least one threaded rod mounted in said frame between said upper and said lower grippers to cause them to be brought closer together in a predetermined direction.

16. An ironing board assembly according to claim 1 wherein said transverse member comprises:

a hoop attached to said upright member; and a horizontal beam attached to said hoop to bisect it, said ironing board being hingedly attached to said beam.

17. An ironing board assembly according to claim 16 wherein said stabilizing means comprises an adhesive rearwardly affixed to said hoop for securing said member to said door.

18. An ironing board assembly according to claim 16 wherein said stabilizing means comprises a plurality of rear elastomeric bumpers for engaging said door.

19. An ironing board assembly according to claim 16 wherein the position of said horizontal beam on said hoop is vertically adjustable.

20. An ironing board assembly arranged for mounting on a door, comprising:

a frame having a transverse member, said transverse member having a rear foam layer with an adhesive backing for securing said member to said door;

an upper gripper attached atop said frame and sized to hang from the top of said door; and an ironing board hingedly attached to said transverse member.

* * * * *